US005340703A

United States Patent [19]

Masumi et al.

[11] Patent Number: 5,340,703

[45] Date of Patent: Aug. 23, 1994

[54] SILVER HALIDE PHOTOGRAPHIC LIGHT-SENSITIVE MATERIAL

[75] Inventors: Satoshi Masumi; Shun Takada, both of Hino, Japan

[73] Assignee: Konica Corporation, Japan

[21] Appl. No.: 938,706

[22] Filed: Sep. 1, 1992

[30] Foreign Application Priority Data

Sep. 11, 1991 [JP] Japan ..... 3-259840

[51] Int. Cl.[5] ..... G03C 7/36; G03C 5/31

[52] U.S. Cl. ..... 430/389; 430/399; 430/557; 430/567

[58] Field of Search ..... 430/399, 557, 389, 567

[56] References Cited

U.S. PATENT DOCUMENTS

| | | | |
|---|---|---|---|
| 4,049,458 | 9/1977 | Boie et al. | 430/557 |
| 4,289,847 | 9/1981 | Ishikawa et al. | 430/389 |
| 4,356,258 | 10/1982 | Usui et al. | 430/557 |
| 4,617,256 | 10/1986 | Kunitz et al. | 430/557 |
| 4,770,983 | 9/1988 | Ogawa et al. | 430/557 |
| 4,994,345 | 2/1981 | Yoshizawa et al. | 430/264 |
| 5,021,333 | 6/1991 | Leyshon et al. | 430/557 |
| 5,063,142 | 11/1991 | Ishikawa | 430/558 |
| 5,066,574 | 11/1991 | Kubota et al. | 430/557 |
| 5,219,716 | 6/1993 | Takada et al. | 430/399 |

FOREIGN PATENT DOCUMENTS

| | | |
|---|---|---|
| 399434 | 11/1990 | European Pat. Off. . |
| 416684 | 3/1991 | European Pat. Off. . |
| 422513 | 4/1991 | European Pat. Off. . |

*Primary Examiner*—Charles L. Bowers, Jr.
*Assistant Examiner*—Mark F. Huff
*Attorney, Agent, or Firm*—Jordan B. Bierman

[57] ABSTRACT

A method of processing a silver halide light-sensitive photographic material in which a replenishing amount of a color developer is not more than 1000 ml/m$^2$ and the material contains a coupler represented by formula I:

Formula I

The processing method of the invention can provides effects that even when treated with processing solution of low replenishing amount, a sensitive material suppresses deterioration in whiteness of non-image area and reproduces yellow close to that of a printing ink.

12 Claims, No Drawings

SILVER HALIDE PHOTOGRAPHIC LIGHT-SENSITIVE MATERIAL

FIELD OF THE INVENTION

The present invention relates to a silver halide photographic light-sensitive material being processed with a color developer that requires low replenishing amount, and more specifically to a silver halide photographic light-sensitive material that provides higher color reproducibility in yellow when processed with a color developer of small replenishing amount; and that is suitable for preparing a color proof based on a transparent monochromatic half-tone image prepared by color-separating a color original.

BACKGROUND OF THE INVENTION

Lately, simple color proofing has been practiced by using a silver halide photographic light-sensitive material (hereinafter referred to as the sensitive material).

Color proofing is a process used in the printing industry and takes place during a sequence that converts a color original into a final print. This is process intended to substitute trial print on an actual printing press. Various color proofing methods are known in the industry, and include silver salt sensitive material method, photopolymer transfer method, and toner transfer method. The commercially available sensitive materials used for these methods include Koncensus (Konica Corp.) Color Art, Fine Checker (Fuji Photo Film Co., Ltd.), Color Key (3M), and Chromarine (Du Pont).

Due to the complexity in transfer process, the photopolymer method cannot speedily provide a color proof image, and also incurs higher cost. The toner transfer method is disadvantageous in terms of environmental and health considerations due to toner fly. In contrast, the silver salt photographic method is free from these disadvantages, and provides good workability. As a result, this method speedily provides a color proof image.

One performance criterion that a color proof image should satisfy is color reproducibility comparable to that of printing inks, and color reproducibility in yellow is especially important.

The yellow coupler described in Japanese Patent Publication Open to Public Inspection (hereinafter referred to as Japanese Patent O.P.I. Publication) No. 123047/1985 provides excellent color reproducibility. The examples in Japanese Patent O.P.I. Publication No. 73250/1990 describe a color proof preparation method that uses a yellow coupler described in Japanese Patent O.P.I. Publication No. 123047/1985.

Recently, the pollution problem has been an important consideration. Therefore, developers for ordinary sensitive materials are now intended for low replenishing amount in order to reduce pollution load.

However, the sensitive materials for color proofing contain anti-irradiation dye in an amount greater than that of ordinary sensitive materials in order to simulate the half-tone reproducibility of final print. Decreased replenishing amount means occurrence of yellow stain, spoiled whiteness on non-image area and deteriorated hues. Therefore, processing a sensitive material with low replenishing amount is difficult.

SUMMARY OF THE INVENTION

The object of the invention is to provide a sensitive material that can provide color reproducibility and whiteness on non-image area comparable to that of printing inks even when developed with a developer of low replenishing amount.

The present invention is attained by a silver halide light-sensitive material having at least one light-sensitive silver halide layer on a support, wherein at least one of the light-sensitive silver halide emulsion layers contains a coupler represented by formula [I] below and the sensitive material can be processed with a processing solution whose replenishing amount of color developer is not more than 1000 ml/m$^2$.

Formula [I]

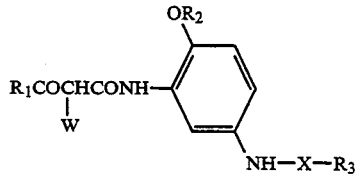

wherein $R_1$ represents an aliphatic group or an aromatic group; $R_2$ represents a non-diffusible aliphatic or aromatic group; $R_3$ represents an aliphatic group having 1 to 6 carbon atoms, and X represents —CO— or —$SO_2$—; W denotes a group represented by any of shown formulas [A] to [E].

The present invention is described in detail below.

DETAILED DESCRIPTION OF THE INVENTION

First, the coupler represented by formula [I] is described as follows.

Formula [I]

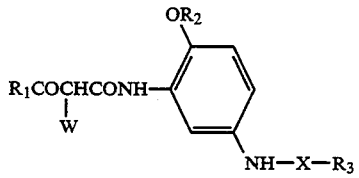

wherein $R_1$ denotes an aliphatic group or an aromatic group; $R_2$ denotes a non-diffusible aliphatic or aromatic group; $R_3$ denotes an aliphatic group having 1 to 6 carbon atoms; and X denotes —CO— or —$SO_2$—; W denotes a group capable of splitting off by coupling reaction with an oxidation product of color developing agent.

The aliphatic group represented by $R_1$ in formula [I] above can be a linear, branched or cyclic type alkyl group, such as a methyl group, an ethyl group, a cyclopropyl group, an isopropyl group, a t-butyl group, a cyclohexyl group, an adamantyl group, an n-dodecyl group, and a 1-hexylnonyl group. The alkyl group represented by $R_1$ can further have a substituent, and the substituent can be, for example, a halogen atom (such as a chlorine atom, a bromine atom), an aryl group (such as a phenyl group, a p-t-octylphenyl group), an alkoxy group (such as a methoxy group), an aryloxy group (such as a 2,4-di-t-amylphenoxy group), a sulfonyl group (such as a methanesulfonyl group), an acylamino group (such as an acetyl group, a benzoyl group), a sulfonylamino group (such as an n-dodecansulfonylamino group), and a hydroxy group.

The aromatic group represented by $R_1$ in formula [I] above can be an aryl group (such as a phenyl group, a 1-naphthyl group, and a 9-anthranyl group). The aryl group represented by $R_1$ can further have a substituent such as a nitro group, a cyano group, an amino group (such as a dimethyl amino group, an anilino group), an alkylthio group (such as a methylthio group); an alkyl group the same as that exemplified for $R_1$ in formula [I] or a substituent that can take a position on the alkyl group represented by $R_1$ in formula [I].

$R_1$ is preferably an alkyl group and more preferably a branched alkyl group and most preferably a t-butyl group.

The non-diffusible aliphatic group represented by $R_2$ in formula [I] can preferably be a linear, branched, or cyclic alkyl group having 6 to 21 carbon atoms, such as a 2,6-dimethylcylohexyl group, a 2-ethylhexyl group, an isotridecyl group, a hexadecyl group, or an octadecyl group. This non-diffusible alkyl group can have a structure, as in formula [II] below, that includes a functional group.

Formula [II]

$$-J-X-R_{12}$$

wherein J is a linear or branched alkylene group having 1 to 20 carbon atoms, such as a methylene, a 1,2-ethylene group, a 1,1-dimethylmethylene group, a 1-decylmethylene group; $R_{12}$ is a linear or branched alkyl group having 1 to 20 carbon atoms, such as a group the same as the alkyl group defined by $R_1$ in formula [I]; X represents a bond such as —O—, —OCO—, —$OSO_2$—, —CO—, —COO—, —CON($R_{13}$)—, —CON($R_{13}$)$SO_2$—, —N($R_{13}$)—, —N($R_{13}$)CO—, —N($R_{13}$)$SO_2$—, —N($R_{13}$)CON($R_{14}$)—, —N($R_{13}$)COO—, —S(O)$_n$—, —S(O)$_n$N($R_{13}$), or —S(O)$_n$N($R_{13}$)CO— (wherein n is an integer of 0 to 2, $R_{13}$ and $R_{14}$ independently represent a hydrogen atom or a group the same as the alkyl or aryl group represented by $R_1$ in formula [I]); and $R_{12}$ and J can be bonded together to form a ring structure.

These alkyl groups represented by $R_2$ can further have a substituent and this substituent can be a same substituent that can take position on the alkyl group represented by $R_1$ in formula [I].

The non-diffusible aromatic group represented by $R_2$ in formula [I] can be the same as that exemplified for the aryl group shown as $R_1$ in the above formula [I]. The aryl group represented by $R_2$ can further have a substituent and the substituent can be the same as that exemplified for the substituent of the aryl group represented by $R_2$ in formula [I]. Among those substituents of the aryl group represented by $R_2$, a linear or branched alkyl group having 4 to 10 carbon atoms is preferable.

The aliphatic group having 1 to 6 carbon atoms and represented by $R_3$ in formula [I] can be a linear, branched, or cylic alkyl group such as a methyl group, a 1-propyl group, a cyclo propyl group, a t-butyl group, a cyclo pentyl group, a cyclo hexyl group, or a hexyl group.

The aliphatic group having 1 to 6 carbon atoms represented by $R_3$ in formula [I] can be a linear, branched, or cyclic alkenyl group having 1 to 6 carbon atoms such as an ethenyl group, an allyl group (a 3-propenyl group), a 2-propenyl group, a 2-butene-1-yl group, a 1-cyclopentadienyl group, or a 1-cyclohexenyl group.

In formula [I] above, X denotes —CO— or —$SO_2$— bond.

In formula [I], W denotes a group capable of splitting off by coupling reaction with an oxidation product of a developing agent, and is preferably a group represented by formula [III] or [IV] below.

Formula [III]

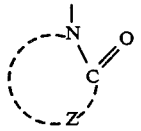

wherein Z represents a non-metal atomic group capable of forming a five- or six-membered ring in conjunction with

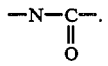

Formula [IV]

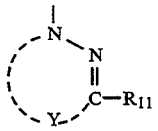

wherein Y represents a non-metal atomic group capable of forming a five- or six-membered ring in conjunction with —N—N=C—, and $R_{11}$ represents a hydrogen atom or a substituent.

In formula [III] above, Z is a non-metal atomic group capable of forming a five- or six-membered ring in conjunction with —N—CO—. Examples of an atomic group required for forming the non-metal atomic group include a methylene, a methyne, a substituted methyne group, —CO—, —N($R_{13}$)— ($R_{13}$ represents a hydrogen atom, an alkyl group, an aryl group, or a heterocyclic group), —N=, —O— and —S(O)$_q$— (q is an integer 0 to 2).

In formula [IV] above, Y represents a non-metal atomic group capable of forming a five- or six-metered ring in conjunction with —N—N=C—. An atomic group necessary for forming the non-metal atomic group can be the same as an atomic group necessary for forming Z in formula [III].

A substituent represented by $R_{11}$ in formula [IV] can be the same as a substituent capable of taking position on the aryl group represented by $R_1$ in formula [I].

The particularly preferable examples of W in formula [I] are groups represented by any of formulas [A] to [E] below.

Formula [A]

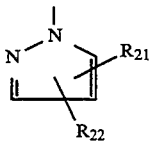

Formula [B]

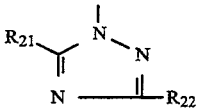

wherein $R_{21}$ and $R_{22}$ independently represent a hydrogen atom or a substituent capable of taking a position on these azole rings, more specifically to a group the same as that of the substituent of the arly group represented by $R_1$ in formula [I]above.; $R_{21}$ and $R_{22}$ can be identical or different with each other and can bond together to form a ring structure.

Formula [C]

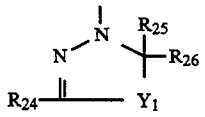

Formula [D]

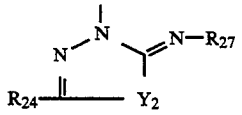

wherein $Y_1$ and $Y_2$ independently represent $—N(R_{23})—$, —O—, or $—S(O)_r—$ ($R_{23}$ denotes a hydrogen atom, an alkyl group, or an aryl group and r is an integer from 0 to 2); $R_{24}$, $R_{25}$, and $R_{26}$ independently represent a group identical to $R_{21}$ and $R_{22}$*above*; $R_{27}$ represents a group, for example, an alkyl group such as a methyl group or an i-propyl group; an cycloalkyl group such as 1-methylcyclopropyl group or a cyclohexyl group; an aryl group such as a phenyl group or a p-t-octylphenyl group; an acyl group such as a pivaloyl group or a benzoyl group; or a sulfonyl group such as a trifluoromethanesulfonyl group or a p-toluensulfonyl group.

Formula [E]

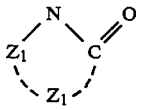

wherein $Z_1$ is a heteroatom in the form of

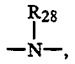

—N=, —O—, —S(O)s— (s is an integer from 0 to 2) or a carbon atom in the form of 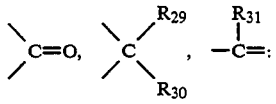

wherein $R_{28}$, $R_{29}$, $R_{30}$, and $R_{31}$ independently represent a hydrogen atom or a group the same as that exemplified for $R_{21}$ and R22 above; $Z_2$ denotes a non-metal atomic group necessary for forming a five- or six-membered ring in conjunction with

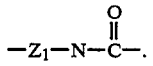

Typical examples of the coupler defined by formula [I] and used for the present invention are described below.

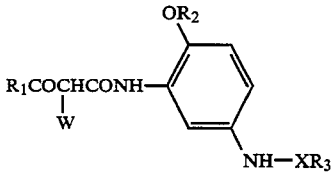

| Coupler No. | $R_1$ | $R_2$ | $XR_3$ | W |
|---|---|---|---|---|
| (1) | $(CH_3)_3C$ | $—CH_2COOC_{12}H_{25}$ | $—SO_2CH_3$ | 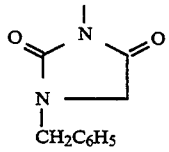 |
| (2) | $(CH_3)_3C$ | $—CH_2COOC_{12}H_{25}$ | $—COCF_3$ | 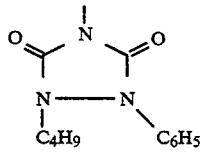 |
| (3) | $(CH_3)_3C$ | $—CH(C_{10}H_{21})COOCH_3$ | $—SO_2CH_3$ | 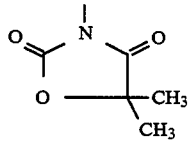 |

-continued
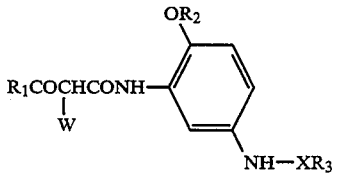
| Coupler No. | $R_1$ | $R_2$ | $XR_3$ | W |
|---|---|---|---|---|
| (4) | $(CH_3)_3C$ | $-C_{13}H_{27}(i)$ | $-COC_3F_7$ | 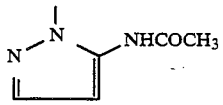 |
| (5) | $(CH_3)_3C$ | $-(CH_2CH_2O)_3C_{10}H_{21}$ | $-SO_2CH_3$ | 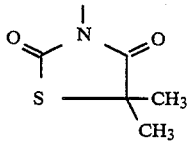 |
| (6) | $(CH_3)_3C$ | 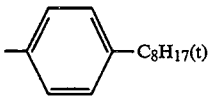 | $-SO_2CH_3$ | 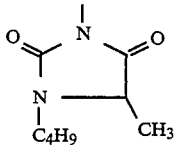 |
| (7) | $(CH_3)_3C$ | 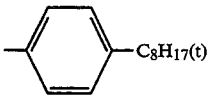 | $-SO_2CH_3$ | 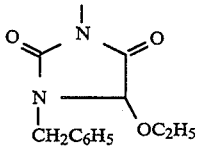 |
| (8) | $(CH_3)_3C$ | 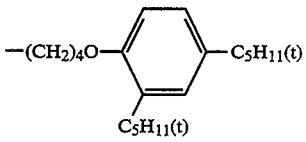 | $-COC(CH_3)_3$ | 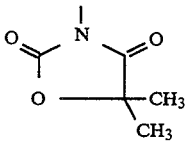 |
| (9) | $(CH_3)_3C$ | $-C_{16}H_{33}$ | $-COCF_3$ | 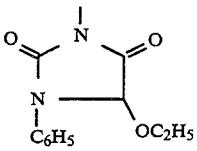 |
| (10) | $(CH_3)_3C$ | 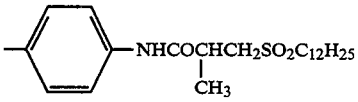 | $-SO_2CH_3$ | 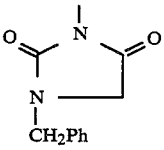 |
| (11) | $(CH_3)_3C$ | 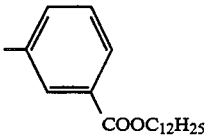 | $-COC_2H_5$ | 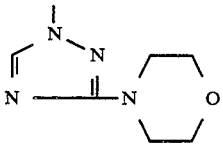 |

-continued
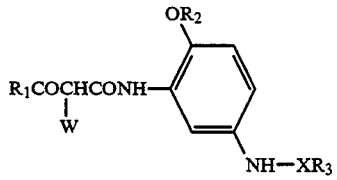
| Coupler No. | $R_1$ | $R_2$ | $XR_3$ | W |
|---|---|---|---|---|
| (12) | $(CH_3)_3C$ | $-CH_2CH(C_2H_5)C_4H_9$ | $-CO-C_6H_{11}$ | 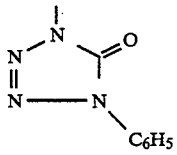 |
| (13) | $(CH_3)_3C$ | 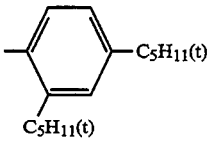 | $-SO_2CH_3$ | 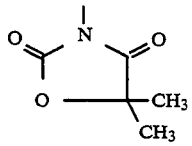 |
| (14) | $(CH_3)_3C$ | 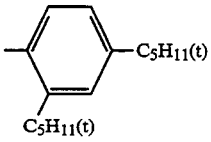 | $-SO_2CH_3$ | 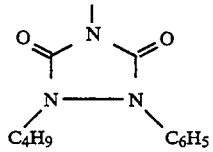 |
| (15) | $(CH_3)_3C$ | 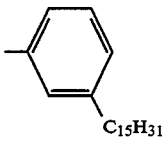 | $-SO_2C_4H_9$ | 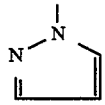 |
| (16) | $(CH_3)_3C$ | $-CH(CH_3)COOC_{12}H_{25}$ | $-COCH_3$ | 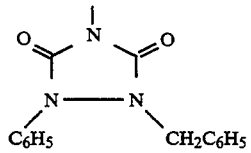 |
| (17) | $(CH_3)_3C$ | $-CH_2CONHC_{12}H_{25}$ | $-SO_2CH_3$ | 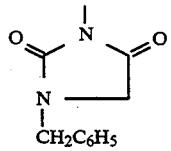 |
| (18) | $(CH_3)_3C$ | $-CH_2CH_2OCOC_{11}H_{23}$ | $-SO_2CH_3$ | 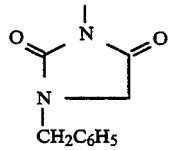 |
| (19) | $(CH_3)_3C$ | $-CH_2CH_2OSO_2C_{16}H_{33}$ | $-COCH_3$ | 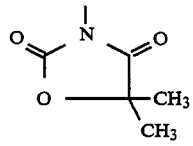 |

-continued
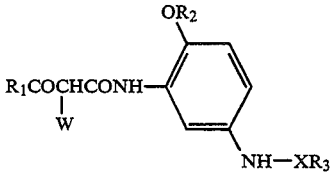
| Coupler No. | $R_1$ | $R_2$ | $XR_3$ | W |
|---|---|---|---|---|
| (20) | $(CH_3)_3C$ | $-CH_2CH_2OCOCH(CH_3)CH_2SO_2C_{12}H_{25}$ | $-SO_2CH_3$ | 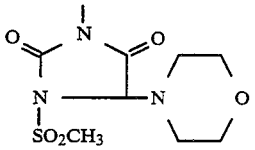 |
| (21) | $(CH_3)_3C$ | 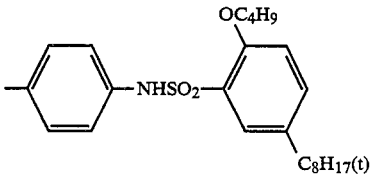 | $-SO_2CH_3$ | 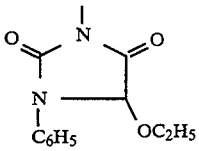 |
| (22) | $(CH_3)_3C$ | 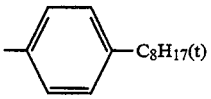 | $-SO_2CH_3$ | 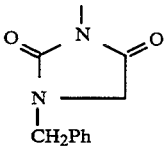 |
| (23) | $(CH_3)_3C$ | $-CH(C_2H_5)COOC_{16}H_{33}$ | $-COCF_3$ | 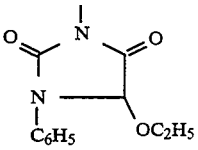 |
| (24) | $(CH_3)_3C$ | $-CH(C_6H_{13})COOC_4H_9$ | $-COCH_3$ | 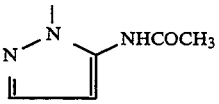 |
| (25) | $(CH_3)_3C$ | $-CH_2CH(C_6H_{13})(C_8H_{17})$ | $-SO_2CH_3$ | 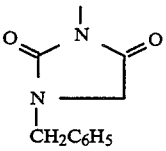 |
| (26) | 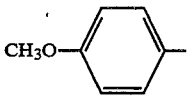 | $-CH_2COOC_{12}H_{25}$ | $-SO_2CH_3$ | 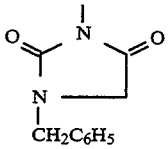 |
| (27) | 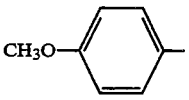 | $-CH_2COOC_{12}H_{25}$ | $-SO_2CH_3$ | 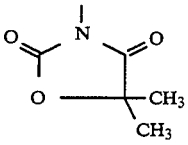 |

-continued

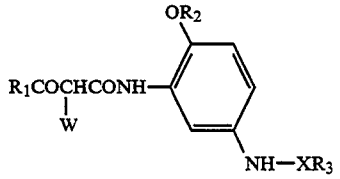

| Coupler No. | $R_1$ | $R_2$ | $XR_3$ | W |
|---|---|---|---|---|
| (28) | $CH_3O$ | $C_8H_{17}(t)$ | $-SO_2CH_3$ | 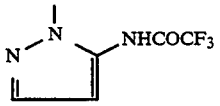 |
| (29) | $CH_3O$ | $C_8H_{17}(t)$ | $-COCH_3$ | 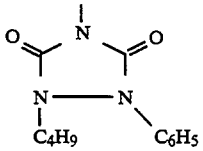 |
| (30) | $CH_3O$ | $-(CH_2)_4O-$ $C_5H_{11}(t)$ $C_2H_{11}(t)$ | $-COC_3F_7$ | 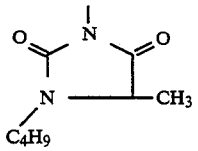 |

The coupler of the invention represented by formula [I] can be readily synthesized by a conventionally known method. A typical example of synthesizing the coupler is described below. Synthesis example: synthesis of example coupler (I)

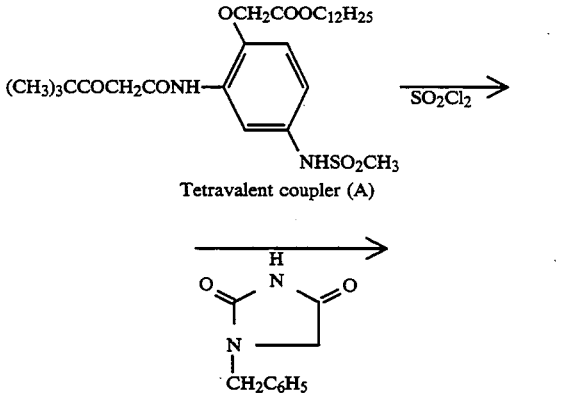

Example coupler (1)

11.1 g of tetravalent coupler (A) was dissolved in 100 ml chloroform, into which 2.8 g of sulfuryl chloride was added dropwise under cooling with ice. Then, the mixture was stirred for one hour and the reactant liquid was washed with water, and dehydrated with magnesium sulfate. Next, the solvent was removed under reduced pressure.

The residue obtained was dissolved in 100 ml acetone, into which 4.0 g of 3-benzylhydantoin and 2.9 g of potassium carbonate were added, and the mixture was heated and refluxed for two hours. The insoluble material was filtered off, and washed with a 5% aqueous potassium carbonate solution and dilute hydrochloric acid, and then dehydrated with magnesium sulfate. Then, the solvent was removed under reduced pressure. The residue was recrystallized by using 70 ml of i-propanol. In this way, the intended example coupler (1), was obtained. The yield was 6.8 g(46%). Tetravalent coupler (A) was synthesized according to a process described in European Patent Publication No. 416684.

The structure of the example coupler (1) was identified with NMR, IR, and mass spectrometric analyses. Example couplers other than example coupler (1) were synthesized according to the method described above while using a relevant starting material.

The coupler of the invention can be used singly or in combination of two or more types. It can also be used in conjunction with any known pivaloylacetanilide or benzoyl acetanilide series coupler.

The coupler of the invention can be incorporated into a silver halide photographic light-sensitive material using various methods.

For example, the coupler can be emulsified in a high boiling solvent (such as phthalic acid ester, phosphoric acid ester, phenol derivative, and alkylamide) and incorporated into the sensitive material. Preferable high boiling solvents are those compounds described in Japanese Patent O.P.I. Publication Nos. 231340/1988, 241547/1988, 253943/1988, and 11262/1989, and the high boiling solvent particularly preferable is a compound defined by formula [V] below.

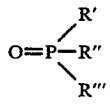

Formula [V]

wherein R', R'', R''' independently represent an alkyl group, a cycloalkyl group, or an aryl group.

Example compounds $O{=}P(-C_8H_{17})_3$ $O{=}P(-C_{12}H_{25})_3$

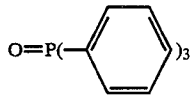

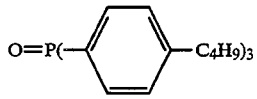

These high boiling organic solvents are preferably used in 10 to 150 wt. % per amount of coupler. A low boiling organic solvent can be used when dissolving the coupler of the invention in the high boiling organic solvent. A process for removing this low boiling organic solvent can be added during or after the coupler emulsification process. An emulsifier may be used in the coupler emulsification process.

In embodying the invention, a magenta coupler and a cyan coupler in addition to the coupler of the invention may be used to form a color image.

The magenta couplers useful in the invention include 5-pyrazolone series, pyrazoloazole series, pyrazolinobenzimidazole series, indazolone series, open-chain acylacetonitrile series couplers, and they are described, for example, in U.S. Pat. Nos. 2,600,788, 3,062,653, 3,512,896, 3,558,318, 3,930,866, Japanese Patent O.P.I. Publication Nos. 29639/1974, 13041/1975. The pyrazoloazole series magenta couplers are particularly preferable. The sensitive material may also contain a tone controlling agent. A preferable high boiling organic solvent used for incorporating the coupler into the sensitive material is a compound defined by formula [V].

Generally used cyan couplers are phenol or naphthol series couplers. These cyan couplers are described, for example, in U.S. Patent Nos. 2,369,992, 2,434,272, 2,698,974, 3,034,892, and 3,839,044, Japanese Patent O.P.I. Publication Nos. 3742/1972, 112038/1975, and 130441/1975.

Among these couplers, diacylaminophenol series cyan couplers are particularly preferable. The sensitive material may also contain a tone controlling agent.

A preferable high boiling organic solvent used for incorporating the coupler into the sensitive material is a phthalic acid ester or phosphoric acid ester, or a compound defined by formula [V].

The type of silver halide grains used for the sensitive material of the present invention may be a type usually used for silver halide emulsion, such as silver bromide, silver iodobromide, silver iodochloride, silver chlorobromide and silver chloride. The preferable silver halide emulsion is a high silver chloride content emulsion.

The high silver chloride grains used in embodying the invention preferably contain not less than 90 mole % of silver chloride. In particular, the grains contain not more than 10 mole % of silver bromide, and not more than 0.5 mole % of silver iodide. More specifically, the preferable grains are silver chlorobromide grains containing 0.1 to 2 mole % of silver bromide.

The silver halide grain type may be used singly or in combination with another silver halide type of different composition, or may be mixed with a silver halide grain type whose silver chloride content is not more than 90 mole %.

In the silver halide emulsion layer containing the silver halide grains whose silver chloride content is not less than 90 mole % the proportion of the silver halide grains, whose silver chloride content is not less than 90 mole %, to the whole silver halide grains in the emulsion layer is not less than 60 wt. %, or, preferably, not less than 80 wt. %.

The silver halide emulsion used for the sensitive material of the invention can be chemically sensitized by sulfur sensitization, selenium sensitization, reduction sensitization, and noble metal sensitization.

The silver halide emulsion used for the sensitive material of the invention can be spectrally sensitized to an intended spectral band by using a dye known in the photographic industry as a sensitizing dye.

Gelatin is advantageously used as a binder (or protective colloid) for the sensitive material of the invention. Other useful binders include gelatin derivative, graft polymer of gelatin and another high molecular compound; protein, sugar derivative, cellulose derivative; hydrophilic colloid of synthetic hydrophilic high molecular material such as homopolymer or copolymer.

The photographic emulsion layer and other hydrophilic colloid layers of the invention are hardened by crosslinking the binder (or protective colloid) molecules by using one or more hardeners singly or in combination. The amount of the hardener being added to these layers should be such that there is no need for adding a hardener into a processing solution in order to harden the sensitive material. However, a hardener may be added to a processing solution.

The hydrophilic colloid layer such as a protective layer or an intermediate layer of the sensitive material of the invention can contain a UV absorber in order to inhibit fogging due to discharge of static charge caused by friction of the sensitive material or to prevent image deterioration due to UV rays.

The sensitive material of the invention can include auxiliary layers such as a filter layer, an anti-fogging layer, and/or an anti-irradiation layer. These layers and/or an emulsion layer may contain a dye that is eluted from the color sensitive material or bleached during a developing process.

A silver halide emulsion layer and/or other hydrophilic colloid layers of the sensitive material of the invention may contain a matting agent in order to decrease gloss, to improve retouchability, and to inhibit the mutual adhesion of sensitive materials.

The sensitive material of the invention can contain a lubricant in order to decrease sliding friction.

The sensitive material of the invention can contain an antistatic agent in order to eliminate static charge. The antistatic agent can be incorporated into a structural layer on a support, opposite to the emulsion layer. It can be incorporated into an emulsion layer and/or a protective colloid layer on the support (emulsion layer side) other than the emulsion layer.

The photographic emulsion layer and/or other hydrophilic colloid layers of the sensitive material of the invention can contain various surfactants in order to improve coating properties, to inhibit static charge, to improve sliding properties, to promote emulsification/-dispersion, to inhibit mutual adhesion, and to improve the photographic properties (such as development promotion, higher contrast, sensitization), etc.

The photographic emulsion layer or other layers of the sensitive material of the invention can be formed on a baryta paper; paper support laminated with α-olefin polymer; paper support whose α-olefin layer is readily peelable; flexible reflective support such as synthetic paper; films made of semi-synthetic or synthetic polymer such as cellulose acetate, cellulose nitrate, polystyrene, polyvinyl chloride, polyethylene terephthalate, polycarbonate, and polyamide; reflective support coated with white pigment; rigid bodes such as glass, metal, and ceramics. The above-mentioned layers can be also formed on a thin reflective support whose thickness is 120 to 160 μm.

The support used for the invention may be either a reflective support or a transparent support, wherein reflectivity is provided by incorporating a white pigment into the support or by forming, on the support, a hydrophilic colloid layer that contains a white pigment.

The white pigment can be an inorganic and or organic pigment, and preferably is an inorganic white pigment. Examples of such pigment include sulfate of alkaline earth metal such as barium sulfate; carbonate of alkaline earth metal such as calcium carbonate; silicas such as silicic acid fine grains, and synthetic silicates; calcium silicate; alumina, hydrated alumina; titanium oxide; zinc oxide; talc, and clay. The preferable white pigments are barium sulfate and titanium oxide.

With the sensitive material of the invention, the surface of support is subjected, according to a specific requirement, to corona discharge, irradiation with UV rays, flame process, and on which layers are formed directly or via a subbing layer (one or more subbing layers that improve various properties such as adhesiveness on support surface, antistatic properties, dimensional stability, abrasion resistance, hardness, anti-halation properties, and friction characteristics).

During the coating process of the photographic sensitive material using a silver halide emulsion of the invention, a thickener may be used to improve coating performance of the emulsion. The especially useful coating method is the extrusion coating or curtain coating each of which can simultaneously form two or more layers.

The sensitive material of the invention can be treated, immediately after color developing, with a solution capable of bleaching and a solution capable of fixing. It may be treated with a solution capable of both bleaching and fixing (bleachfixer). The bleacher used is a metal complex salt of organic acid.

The color developing agent used for the invention is described below.

The color developing agent used for the invention is preferably a p-phenylenediamine compound having a water soluble group. This p-phenylenediamine compound has at least one water soluble group on the amino group or benzene ring. Preferable water soluble groups are as follows:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (m and n independently denote an integer larger than 0.) and a —COOH group, and a $-SO_3H$ group. Typical examples of p-phenylenediamine compound are listed below. However, the scope of the invention is not limited to these examples.

Example compounds

CD-1

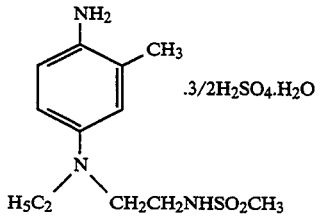

CD-2

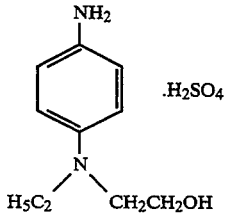

CD-3

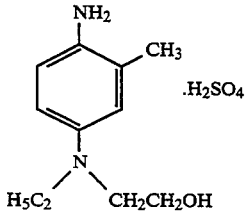

CD-4

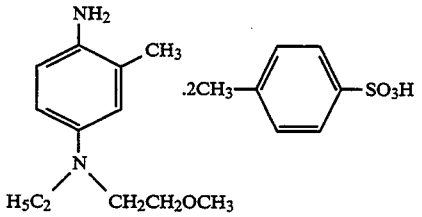

CD-5

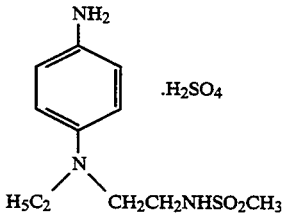

The particularly preferable color developing agent is CD-2.

The color developing agent is added to a developer at a rate of not less than 0.01 mole/1, and preferably at a rate of 0.015 mole/1 to 0.03 mole/1.

The color developing agent can contain a known alkaline agent, preservative, anti-fogging agent, fluorescent brightener, anti-foaming agent, coloring accelerator, etc.

Though not limitative, the color developing time is usually 30 seconds to 4 minutes and the temperature of the color developer is usually 20° to 45° C.

Replenishing amount is preferably 20 ml/m$^2$ to 600 ml/m$^2$, in particular, 50 ml/m$^2$ to 400 ml/m$^2$.

EXAMPLES

The invention is hereunder described in detail by referring to preferable examples.

EXAMPLE 1

On the front face of a paper support whose front face is laminated with polyethylene containing titanium oxide and whose back face is laminated with polyethylene (thickness 110 μm) were formed the following 1st through 11 layers. A backing layer was formed by coating on the back face of the support. Thus, a positive-type sensitive material for color proofing was prepared.

Coating weight is indicated in g/m$^2$. The coating weight of silver halide emulsion is indicated as a value converted into metal silver.

| | |
|---|---|
| 11th layer (protective layer) | |
| Gelatin | 1.0 |
| $SiO_2$ (mean grain size 3 μm) | 0.03 |
| 10th layer (UV absorbing layer) | |
| Gelatin | 0.5 |
| UV absorber (UV-1) | 0.5 |
| UV absorber (UV-2) | 0.5 |
| Color mixing inhibitor | 0.01 |
| DNP | 0.2 |
| Anti-irradiation dye (AI-1) | 0.01 |
| Anti-irradiation dye (AI-2) | 0.01 |
| 9th layer (blue-sensitive layer) | |
| Gelatin | 1.3 |
| Blue-sensitive silver chlorobromide emulsion spectrally sensitized by sensitizing dye (D-1) (Br, 65 mole %; Cl, 35 mole %) | 0.3 |
| Yellow coupler (shown in Table-1) | 0.4 |
| Dye-image stabilizer (ST-1) | 0.3 |
| Anti-stain agent (HQ-2) | 0.02 |
| TOPO | 0.4 |

-continued

| | |
|---|---|
| 8th layer (intermediate layer) | |
| Gelatin | 0.5 |
| Color mixing inhibitor (HQ-1) | 0.03 |
| DNP | 0.1 |
| 7th layer (yellow colloidal silver layer) | |
| Gelatin | 0.5 |
| Yellow colloidal silver | 0.1 |
| PVP | 0.03 |
| 6th layer (intermediate layer) | |
| Gelatin | 0.3 |
| 5th layer (green-sensitive layer) | |
| Gelatin | 1.0 |
| Green-sensitive silver chlorobromide emulsion spectrally sensitized by sensitizing dye (D-2) (Br, 65 mole %; Cl, 35 mole %) | 0.5 |
| Magenta coupler (M-1) | 0.35 |
| Tone controlling agent (MY-1) | 0.1 |
| Anti-stain agent (HQ-2) | 0.02 |
| TOPO | 0.4 |
| 4th layer (intermediate layer) | |
| Gelatin | 0.3 |
| Color mixing inhibitor (HQ-1) | 0.03 |
| DNP | 0.1 |
| 3rd layer (red-sensitive layer) | |
| Gelatin | 1.0 |
| Red-sensitive silver chlorobromide emulsion sensitized by sensitizing dye (D-3) (Br, 65 mole %; Cl, 35 mole %) | 0.3 |
| Cyan coupler (C-1) | 0.3 |
| High boiling organic solvent (HBS-1) | 0.1 |
| Anti-stain agent (HQ-2) | 0.02 |
| 2nd layer (intermediate layer) | |
| Gelatin | 0.3 |
| Color mixing inhibitor (HQ-1) | 0.01 |
| DNP | 0.05 |
| 1st layer (anti-halation layer) | |
| Gelatin | 0.5 |
| Black colloidal silver | 0.12 |
| PVP | 0.03 |
| Backing layer | |
| Gelatin | 6.5 |
| $SiO_2$ (mean grain size 3 μm) | 0.1 |

As coating aids for both the emulsion layer side and the backing layer side, surfactants (S-1) and (S-2) as well as hardeners (H-1) and (H-2) were used.

M-1

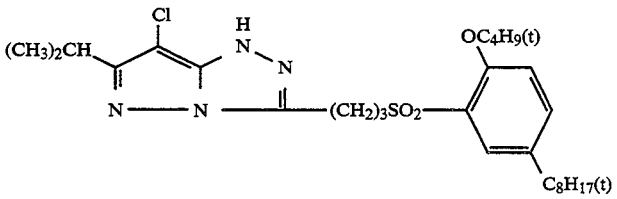

C-1

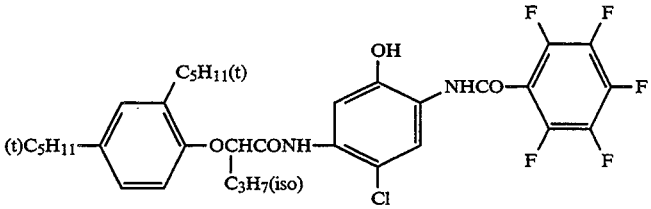

D-1

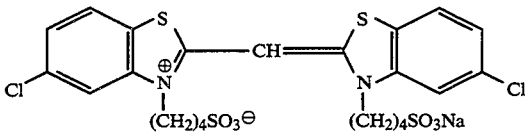

-continued

D-2

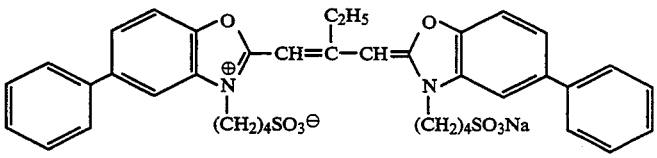

D-3

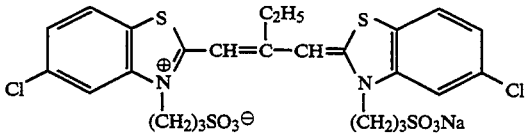

UV-1

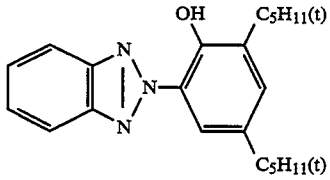

UV-2

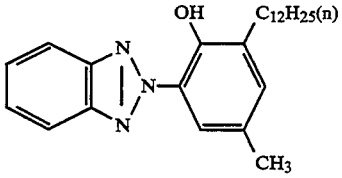

AI-1

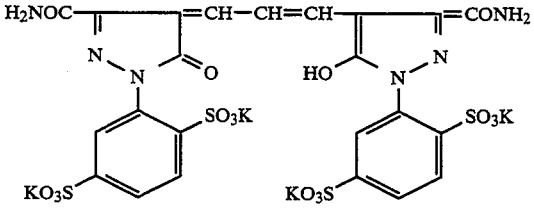

AI-2

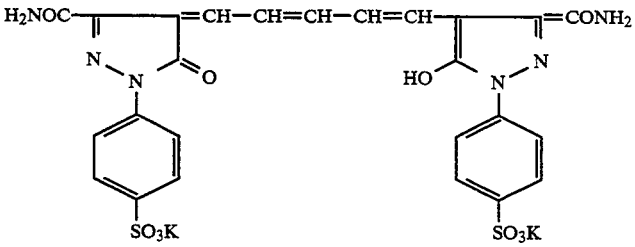

DNP: dinonylphthalate
PVP: polyvinylpyrrolidone

TOPO: $O{=}P(C_8H_{17})_3$

Comparative coupler Y-1

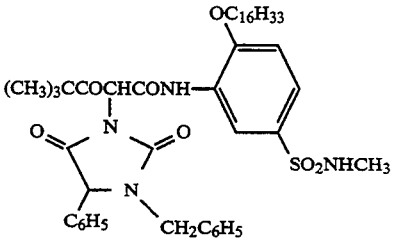

(Coupler described in Japanese Patent O.P.I. Publication No. 38932/1988)

Comparative coupler Y-2

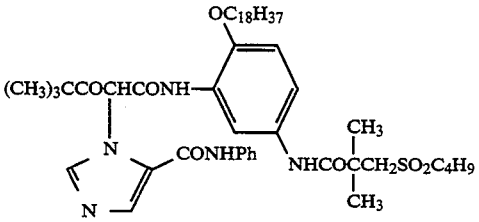

(Coupler described in Japanese Patent O.P.I. Publication No. 123047/1988)

Comparative coupler Y-3

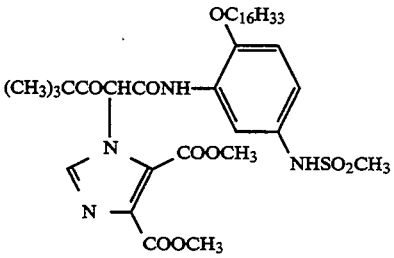

(Coupler described in U.S. Pat. No. 4,388,403)

Comparative coupler Y-4

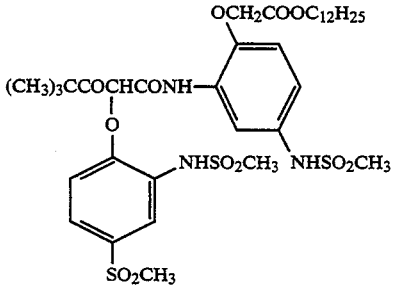

(Coupler described in European Patent Publication No. 416684)

-continued

ST-1

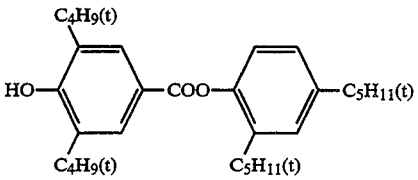

HQ-1

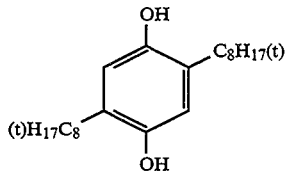

HQ-2

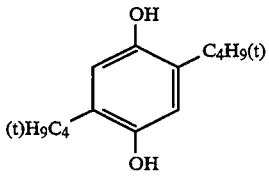

MY-1

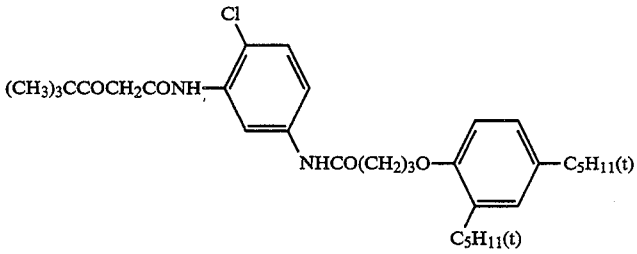

HBS-1

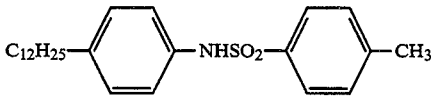

S-1

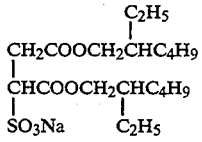

S-2

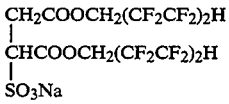

H-1

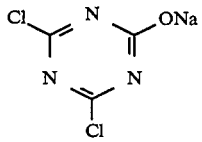

H-2

Samples are exposed by a conventional method and treated according to the processes specified below, and the yellow tone and the whiteness on non-image area were examined. The results are summarized in Table 1.

| | | |
|---|---|---|
| Immersion in color developer | 15 sec. | 38° C. |
| Light fogging treatment | 10 sec. at 1 lux | |
| Color developing | 2 min. | 38° C. |
| Bleach-fixing | 45 sec. | 33° C. |
| Stabilizing | 1 min. 30 sec. | 33° C. |
| Drying | 1 min. | 70° C. |

| Color developer composition | |
|---|---|
| Color developing agent | shown in Table 1 |
| Potassium carbonate | 25.0 g |
| Sodium chloride | 0.1 g |
| Sodium bromide | 0.2 g |
| Sodium sulfite anhydride | 2.0 g |
| Benzyl alcohol | 10.0 ml |

Water was added to 1 liter and the pH was adjusted to 10.15 with sodium hydroxide.

| Bleach-fixer composition | |
|---|---|
| Sodium ferric ethylenediaminetetraacetate | 60 g |
| Ammonium thiosulfate | 100 g |
| Sodium bisulfite | 20 g |
| Water was added to 1 liter, and the pH was adjusted to 7.0 with sulfuric acid. | |
| Stabilizer composition | |
| 5-chloro-2-methyl-4-isothiazoline-3-one | 1.0 g |
| Ethyleneglycol | 1.0 g |
| 1-hydroxyethylidene-1,1-diphosphonic acid | 2.0 g |
| Ethylenediaminetetraacetic acid | 1.0 g |
| Ammonium hydroxide (20% aqueous solution) | 3.0 g |
| Ammonium sulfite | 3.0 g |
| Fluorescent brightener (4,4'-diaminostylbendiphosphonicacid derivative) | 1.5 g |

Water was added to 1 liter, and the pH was adjusted to 7.0 with sulfuric acid or potassium hydroxide. Developing was continued until the replenishment of color developer reached three times the capacity of the developer tank (3 rounds).

TABLE 1

| | Coupler | HBS | CD | Replenishment (ml) | Color reproducibility | Whiteness in non-image area ($\Delta D_B$) | |
|---|---|---|---|---|---|---|---|
| No. 1 | Y-1 | DNP | CD-3 | 1200 | C | 0.003 | Comparative |
| No. 2 | Y-2 | DNP | CD-3 | 1200 | C | 0.002 | Comparative |
| No. 3 | Y-3 | DNP | CD-3 | 1200 | C | 0.003 | Comparative |
| No. 4 | (1) | DNP | CD-3 | 1200 | C | 0.002 | Comparative |
| No. 5 | (2) | DNP | CD-3 | 1200 | C | 0.001 | Comparative |
| No. 6 | (3) | DNP | CD-3 | 1200 | C | 0.001 | Comparative |
| No. 7 | Y-1 | DNP | CD-3 | 500 | D | 0.028 | Comparative |
| No. 8 | Y-3 | DNP | CD-3 | 500 | D | 0.026 | Comparative |
| NO. 9 | Y-4 | DNP | CD-3 | 500 | D | 0.030 | Comparative |
| No. 10 | (1) | DNP | CD-3 | 500 | C | 0.003 | Invention |
| No. 11 | (2) | DNP | CD-3 | 500 | C | 0.002 | Invention |
| No. 12 | (3) | DNP | CD-3 | 500 | C | 0.003 | Invention |
| No. 13 | Y-1 | DNP | CD-2 | 500 | D | 0.025 | Comparative |
| No. 14 | Y-3 | DNP | CD-2 | 500 | D | 0.028 | Comparative |
| No. 15 | (1) | DNP | CD-2 | 500 | B | 0.003 | Invention |
| No. 16 | (2) | DNP | CD-2 | 500 | B | 0.004 | Invention |
| No. 17 | (3) | DNP | CD-2 | 500 | B | 0.003 | Invention |
| No. 18 | (1) | TOPO | CD-2 | 500 | A | 0.002 | Invention |
| No. 19 | (2) | TOPO | CD-2 | 500 | A | 0.002 | Invention |
| No. 20 | (3) | TOPO | CD-2 | 500 | A | 0.003 | Invention |
| No. 21 | Y-4 | TOPO | CD-2 | 280 | D | 0.064 | Comparative |
| No. 22 | (1) | TOPO | CD-2 | 280 | A | 0.006 | Invention |
| No. 23 | (2) | TOPO | CD-2 | 280 | A | 0.008 | Invention |
| No. 24 | (3) | TOPO | CD-2 | 280 | A | 0.009 | Invention |
| No. 25 | (8) | TOPO | CD-2 | 280 | A | 0.012 | Invention |
| No. 26 | (14) | TOPO | CD-2 | 280 | A | 0.008 | Invention |
| No. 27 | (18) | TOPO | CD-2 | 280 | A | 0.011 | Invention |
| No. 28 | (22) | TOPO | CD-2 | 280 | A | 0.008 | Invention |
| No. 29 | (24) | TOPO | CD-2 | 280 | A | 0.013 | Invention |
| No. 30 | (29) | TOPO | CD-2 | 280 | A | 0.008 | Invention |

Tone: visually evaluated on a sample processed at the end of the third round
A: very close to hue of printing ink
B: close to hue of printing ink
C: slightly different from hue of printing ink
D: deviated from hue printing ink
$\Delta D_B$: difference in density taken on non-image area by using blue light, between a sample first treated and a sample finally treated As can be understood from the results in Table 1, in the case of samples using a conventional coupler, a decreased replenishing amount resulted in deterioration both in color reproducibility and whiteness on non-image area. In contrast, with the samples using a coupler of the invention, there was virtually no deterioration in whiteness on non-image area. In addition, use of TOPO as a HBS enabled close reproduction of hue of printing ink.

EXAMPLE 2

Samples were treated in a manner identical to that in example 1 except that example compound CD-1 was used as a color developing agent.

As the result, the peak wavelength in spectral reflection density of shifted by 3 nm to the longer wavelength band, and there was slight deviation from tone of printing ink. However, the effect of the invention is still apparent.

EXAMPLE 3

Samples were treated in a manner identical to that in example 1 except that the sensitive material for color proofing had a silver halide emulsion whose halogen composition was chlorine:bromine=95:5 (molar ratio), and the color developer lacked benzyl alcohol, and color developing time was 25 seconds.

As the result, the effect of this invention was obtained.

EXAMPLE 4

A negative-type sensitive material for color proofing was prepared by forming on the front face of a paper support (thickness 130 μm), whose front face was laminated with polyethylene containing titanium oxide and whose back face was laminated with polyethylene, and by forming a backing layer on the back face of the support. Coating weight is indicated in the unit of g/m$^2$. The coating weight of silver halide emulsion is indicated as a value converted into metal silver.

| | |
|---|---|
| 7th layer (protective layer) | |
| Gelatin | 1.0 |
| $SiO_2$ (mean grain size 3 μm) | 0.03 |
| 6th layer (UV absorbing layer) | |
| Gelatin | 0.4 |
| UV absorber (UV-1) | 0.2 |
| UV absorber (UV-2) | 0.2 |
| Color mixing inhibitor (HQ-1) | 0.01 |
| DNP | 0.2 |
| PVP | 0.2 |
| Anti-irradiation dye (AI-3) | 0.07 |
| 5th layer (red-sensitive layer) | |
| Gelatin | 1.3 |
| Red-sensitive silver halide emulsion layer spectrally sensitized by sensitizing dye (D-4) (Br, 80 mole %; Cl, 20 mole %) | 0.22 |
| Cyan coupler (C-1) | 0.3 |
| High boiling organic solvent (HBS-1) | 0.15 |
| Anti-stain agent (HQ-1) | 0.02 |
| 4th layer (UV absorbing layer) | |
| Gelatin | 0.6 |
| UV absorber (UV-1) | 0.3 |
| UV absorber (UV-2) | 0.3 |
| Color mixing inhibiter | 0.01 |
| DNP | 0.2 |
| Anti-irradiation dye (AI-4) | 0.01 |
| 3rd layer (green-sensitive layer) | |

-continued

| | |
|---|---|
| Gelatin | 1.2 |
| Green-sensitive silver halide spectrally sensitized by sensitizing dye (D-5) (Br, 80 mole %; Cl, 20 mole %) | 0.35 |
| Magenta coupler (M-1) | 0.2 |
| Magenta coupler (M-2) | 0.2 |
| Tone controlling agent (MY-1) | 0.15 |
| Anti-stain agent (HQ-1) | 0.02 |
| TOPO | 0.4 |
| 2nd layer (intermediate layer) | |
| Gelatin | 0.6 |
| Color mixing inhibitor (HQ-1) | 0.02 |

-continued

| | |
|---|---|
| Yellow coupler (shown in Table 1) | 0.4 |
| Anti-stain agent (HQ-1) | 0.02 |
| TOPO | 0.38 |
| Backing layer | |
| Gelatin | 6.0 |
| $SiO_2$ (mean grain size 3 μm) | 0.1 |

As coating aids for both the emulsion layer side and the backing layer side, surfactants (S-1) and (S-2) as well as hardeners (H-1) and (H-2) were used.

D-4

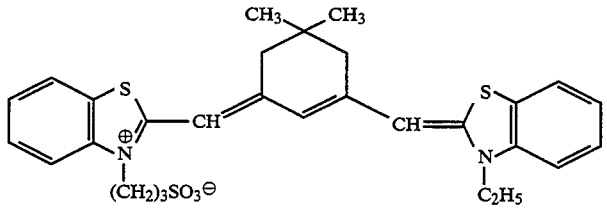

D-5

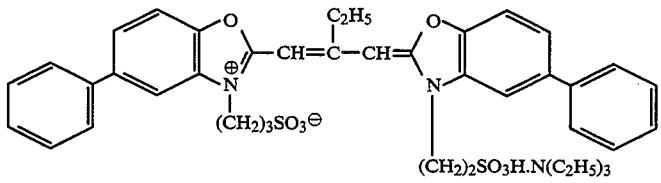

D-6

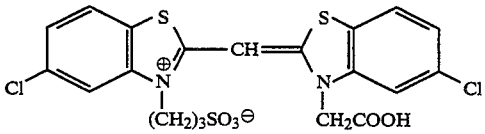

AI-3

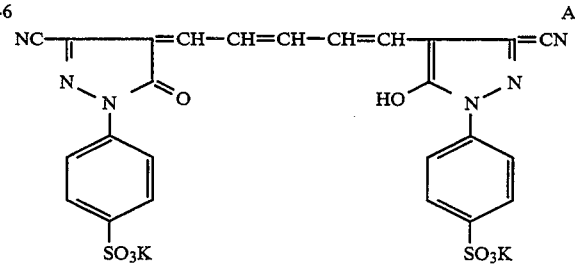

AI-4

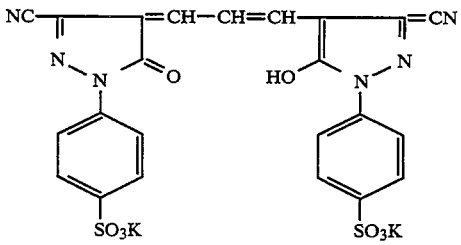

AI-5

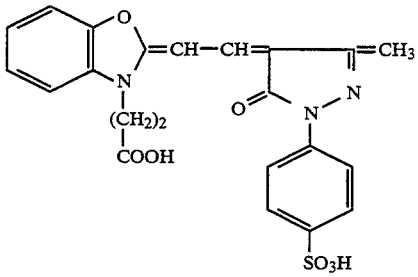

M-2

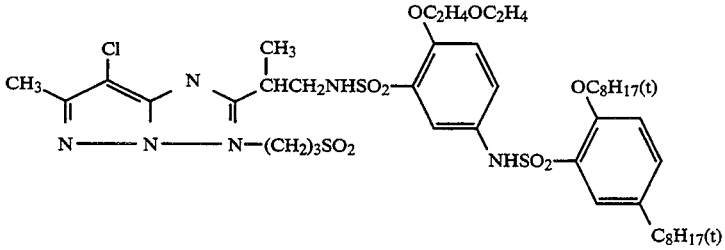

| | |
|---|---|
| DNP | 0.2 |
| Anti-irradiation dye | 0.03 |
| 1st layer (blue-sensitive layer) | |
| Gelatin | 1.2 |
| Blue-sensitive silver halide emulsion spectrally sensitized by sensitizing dye (D-6) (Br, 80 mole %; Cl, 20 mole %) | 3.5 |

Samples were exposed by a conventional method and treated according to the processes specified below.

| Processing steps | | |
|---|---|---|
| Color developing | 2 min. | 38° C. |
| Bleach-fixing | 45 sec. | 33° C. |

-continued

| Processing steps | | |
|---|---|---|
| Stabilizing | 1 min. 30 sec. | 33° C. |
| Drying | 1 min. | 70° C. |

The processing solutions used in the above processes were identical to those of example 1.

Samples were evaluated in a manner identical to that of example 1. As the result, the effect of the invention was also obtained with the negative-type sensitive material.

The processing method of the invention can provides effects that even when treated with processing solution of low replenishing amount, a sensitive material suppresses deterioration in whiteness of non-image area and reproduces yellow close to that of a printing ink.

What is claimed is:

1. A method of processing a silver halide light-sensitive photographic material which comprises the steps of:

exposing said material to light and color developing said exposed material with a color developer; wherein a replenishing amount of said color developer is not more than 1000 ml/m$^2$ and said material contains a coupler represented by formula I;

formula I

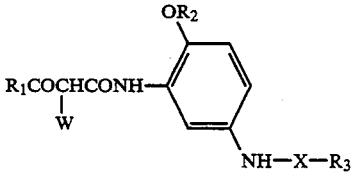

wherein $R_1$ represents an aliphatic group or an aromatic group, $R_2$ represents non-diffusible aliphatic or aromatic group, $R_3$ represents an aliphatic group having 1 to 6 carbon atoms; X represents —CO— or —$SO_2$—; W is a group represented by formulae A, B, C, D or E:

formula A

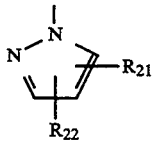

formula B

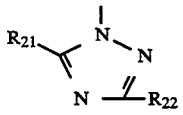

wherein $R_{21}$ and $R_{22}$ each represents a hydrogen atom or a substituent capable of taking a position on these azole rings; and $R_{21}$ and $R_{22}$ are identical or different and may form a ring structure connecting each other, formula C

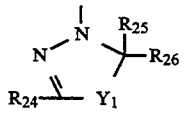

-continued formula D

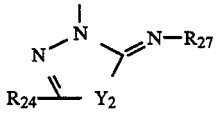

wherein $Y_1$ and $Y_2$ each represents —N($R_{23}$)—, —O— or —S(O)$_r$— wherein $R_{23}$ represents a hydrogen atom, an alkyl group or an aryl group, r is an integer from 0 to 2, $R_{24}$, $R_{25}$ and $R_{26}$ each identical to $R_{21}$ and $R_{22}$ of formula A, $R_{27}$ represents an alkyl group, a cycloalkyl group, an aryl group, an acyl group or a sulfonyl group, Formula E

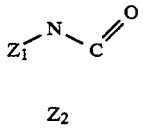

wherein $Z_1$ represents a heteroatom in the form of

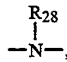

—N=, —O—, —S (O)$_s$—wherein s is an integer from 0 to 2; or a carbon atom in the form of

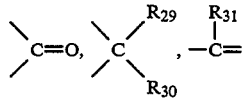

wherein $R_{28}$, $R_{29}$, $R_{30}$ and $R_{31}$ each represents a hydrogen atom or group identical to $R_{21}$ or $R_{22}$ of formula A; $Z_2$ represents non-metal atomic group necessary for forming a five- or six-membered ring in conjunction with

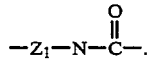

2. The method of claim 1 wherein $R_1$ represents a linear, branched or cyclic type alkyl group which may have a substituent; or an aryl group having 6 to 14 carbon atoms which may have a substituent.

3. The method of claim 2 wherein $R_1$ is an alkyl group.

4. The method of claim 3 wherein $R_1$ is a t-butyl group.

5. The method of claim 1 wherein the silver halide light-sensitive photographic material comprises an emulsion layer containing a silver halide grain having not less that 90 mol % of silver chloride, not more than 10 mol % of silver bromide and not more than 0.5 mol % of silver iodide.

6. The method of claim 5 wherein the silver halide grain is silver chlorobromide having a content of silver bromide 0.1 to 2 mol %.

7. The method of claim 1 wherein a total weight of the silver halide grains having not less than 90 mole % of silver chloride content, contained in the emulsion layer, is not less than 60 weight %.

8. The method of claim 7 wherein the total weight of the silver halide grains having not less than 90 mol % of silver chloride content, contained in the emulsion layer, is not less than 80 weight %.

9. The method of claim 1 wherein the replenishing amount is 20 ml/m$^2$ to 600 ml/m$^2$.

10. The method of claim 9 wherein the replenishing amount is 50 ml/m$^2$ to 400 ml/m$^2$.

11. A method of processing a silver halide light-sensitive photographic material which comprises the steps of:

exposing said material to light and color developing said exposed material with a color developer, wherein a replenishing amount of said color developer is not more than 1000 ml/m$^2$ and said material contains a coupler represented by formula I, formula I

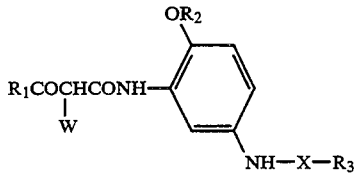

wherein $R_1$ represents an aliphatic group or an aromatic group;

$R_2$ represents an aryl group having a substituent of alkyl group having 4 through 10 carbon atoms, or a linear, branched or cyclic alkyl group having 6 to 21 carbon atoms which may have a functional group represented by formula II, $$-J-X_2-R_{12}$$ formula II wherein J represents a linear or branched alkylene group having 1 to 20 carbon atoms, $R_{12}$ represents a linear or branched alkyl group having 1 to 20 carbon atoms, $X_2$ represents —O—, —OCO—, —$OSO_2$, —COO—, —$CON(R_{13})$—, —$CON(R_{13})SO_2$—, —$N(R_{13})$—, —$N(R_{13})CO$—, —$N(R_{13})SO_2$—, —$N(R_{13})CON(R_{14})$—, —$N(R_{13})COO$—, —$S(O)_n$—, —$S(O)_nN(R_{13})$ or —$S(O)_nN(R_{13})CO$—, wherein $R_{13}$ and $R_{14}$ each represents a hydrogen atom or a group being identical to the alkyl group or the aryl group represented by $R_1$ in the formula I, n is a integer of 0 through 2;

$R_3$ represents an aliphatic group having 1 to 6 carbon atoms; X represents —CO— or —$SO_2$—;

W is a group represented by formulae A, B, C, D or E:

formula A

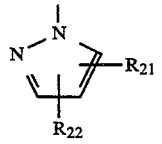

formula B

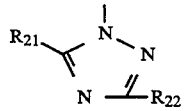

wherein $R_{21}$ and $R_{22}$ each represents a hydrogen atom or a substituent capable of taking a position on these azole rings, and $R_{21}$ and $R_{22}$ are identical or different and may form a ring structure connecting each other;

formula C

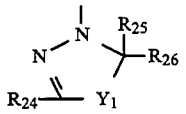

formula D

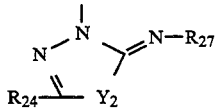

wherein $Y_1$ and $Y_2$ each represents —$N(R_{23})$—, —O— or —$S(O)_r$— wherein $R_{23}$ represents a hydrogen atom, an alkyl group or an aryl group, r is an integer of 0 through 2, $R_{24}$, $R_{25}$ and $R_{26}$ each identical to $R_{21}$ and $R_{22}$ of formula A, $R_{27}$ represents an alkyl group, a cycloalkyl group, an aryl group, an acyl group or a sulfonyl group;

Formula E

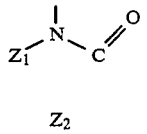

wherein $Z_1$ represents a hetero-atom in the form of

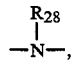

—N═, —O—, —$S(O)_s$— wherein s is an integer 0 through 2, or a carbon atom in the form of

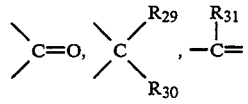

wherein $R_{28}$, $R_{29}$, $R_{30}$ and $R_{31}$ each represents a hydrogen atom or group identical to $R_{21}$ or $R_{22}$ of formula A, $Z_2$ represents non-metal atomic group necessary for forming a five- or six-membered ring in conjunction with

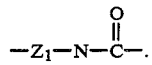

12. A method of processing a silver halide light-sensitive photographic material which comprises the steps of:

preparing the photographic material, exposing, developing, fixing and stabilizing;

wherein the material comprises a support having provided thereon at least one layer made from a silver halide emulsion containing a silver halide grain having not less than 90 mol % of a silver chloride, not more than 0.5 mol % of silver iodide and having 0.1 to 2 mol % of silver bromide wherein the layer made from the silver halide emulsion can be processed with a processing solution to which a replenishing amount of a color developer is 50 ml/m$^2$ to 400 ml/m$^2$; and a weight of the grains having not less than 90 mol % of silver chloride, being not less than 80 weight %; and at least one of the layers contains a compound represented by formula I, formula I

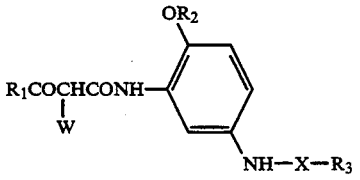

wherein $R_1$ represents an aliphatic group or an aromatic group;

$R_2$ represents an aryl group having a substituent of alkyl group having 4 through 10 carbon atoms, or a linear, branched or cyclic alkyl group having 6 to 21 carbon atoms which may have a functional group represented by formula II, $$-J-X_2-R_{12}$$ formula II wherein J represents a linear or branched alkylene group having 1 to 20 carbon atoms, $R_{12}$ represents a linear or branched alkyl group having 1 to 20 carbon atoms, $X_2$ represents —O—, —OCO—, —$OSO_2$, —COO—, —CON($R_{13}$)—, —CON($R_{13}$)$SO_2$—, —N($R_{13}$)—, —N($R_{13}$)CO—, —N($R_{13}$)$SO_2$—, —N($R_{13}$)CON($R_{14}$)—, —N($R_{13}$)COO—, —S(O)$_n$—, —S(O)$_n$N($R_{13}$) or —S(O)$_n$N($R_{13}$)CO—, wherein $R_{13}$ and $R_{14}$ each represents a hydrogen atom or a group being identical to the alkyl group or the aryl group represented by $R_1$ in formula I, n is an integer of 0 through 2;

$R_3$ represents an aliphatic group having 1 to 6 carbon atoms; X represents —CO— or —$SO_2$—;

W is a group represented by formulae A, B, C, D or E:

formula A

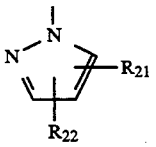

formula B

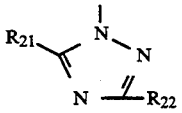

wherein $R_{21}$ and $R_{22}$ each represents a hydrogen atom or a substituent capable of taking a position on these azole rings, and $R_{21}$ and $R_{22}$ are identical or different and may form a ring structure connecting each other;

formula C

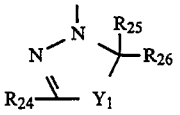

formula D

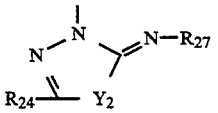

wherein $Y_1$ and $Y_2$ reach represents —N($R_{23}$)—, —O— or —S(O)$_r$— wherein $R_{23}$ represents a hydrogen atom, an alkyl group or an aryl group, r is an integer of 0 through 2, $R_{24}$, $R_{25}$ and $R_{26}$ each identical to $R_{21}$ and $R_{22}$ of formula A, $R_{27}$ represents an alkyl group, a cycloalkyl group, an aryl group, an acyl group or a sulfonyl group;

Formula E

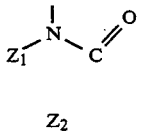

wherein $Z_1$ represents a hetero-atom in the form of

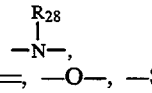

—N=, —O—, —S(O)$_s$— wherein s is an integer 0 through 2, or a carbon atom in the form of

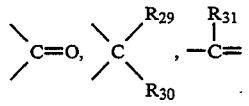

wherein $R_{28}$, $R_{29}$, $R_{30}$ and $R_{31}$ each represents a hydrogen atom or group identical to $R_{21}$ or $R_{22}$ of formula A, $Z_2$ represents non-metal atomic group necessary for forming a five- or six-membered ring in conjunction with

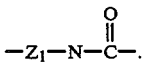

* * * * *